US005661260A

United States Patent [19]

Cho et al.

[11] Patent Number: 5,661,260

[45] Date of Patent: Aug. 26, 1997

[54] FIN ASSEMBLY FOR A VEHICLE

[75] Inventors: Chahee P. Cho, Portsmouth; Stanley J. Olson, Newport, both of R.I.

[73] Assignee: The United States of America as represented by the Secretary of the Navy, Washington, D.C.

[21] Appl. No.: 649,834

[22] Filed: May 1, 1996

[51] Int. Cl.[6] ..... B63H 20/12

[52] U.S. Cl. ..... 114/126; 318/580

[58] Field of Search ..... 318/588, 580; 114/152, 331, 144 R, 144 A, 144 E, 330, 126, 162, 144 RE; 310/152, 67 R; 307/109

[56] References Cited

U.S. PATENT DOCUMENTS 4,142,696 3/1979 Nottingham ..... 244/3.16

4,512,537 4/1985 Sebestyen et al. ..... 244/3.21

5,235,930 8/1993 Pendleton ..... 114/312

*Primary Examiner*—William M. Shoop, Jr.

*Assistant Examiner*—Kim Lockett

*Attorney, Agent, or Firm*—Michael J. McGowan; Michael F. Oglo; Prithvi C. Lall

[57] ABSTRACT

A fin assembly for effecting guidance of a vehicle through a fluid medium includes an electromagnet fixed in a portion of the vehicle, and a rigid shaft fixed to a hull portion of the vehicle and extending outwardly therefrom and in alignment with the electromagnet. A fin is rotatably mounted on the shaft and is, at least in part, a permanent magnet. A switch assembly is provided in the vehicle for effecting in a first portion of the electromagnet an attractive force between the electromagnet and the permanent magnet, and in a second portion of the electromagnet a repelling force therebetween, to cause the fin to rotate on the shaft in a selected direction to effect the guidance of the vehicle.

9 Claims, 4 Drawing Sheets

FIN ASSEMBLY FOR A VEHICLE

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to guidance control means for vehicles for movement through fluid mediums, and is directed more particularly to a fin assembly for effecting guidance of such vehicles.

(2) Description of the Prior Art

It is current practice to fix marine fins, such as torpedo fins, to a shaft which, in turn, is fixed to a motor rotor within the hull of the torpedo. Upon actuation of the motor stator, the rotor turns and with it the shaft and the fin. Electrical current required for high force application to the fin can be quite high. In a confined space, such as in a torpedo, thermal limitations pose a problem. To avoid the need for high electrical currents, the motor can be equipped with large permanent magnets. However, space and weight limitation impose limitations on sizes of magnets. Further, the shaft typically is provided with splines by which the shaft is connected to a grooved portion of the fin. The splines on the motor shaft have, on occasion, stripped, so that while the shaft turns appropriately, the fin does not.

Thus, there is a need for a fin control assembly having facility for operating under high current conditions without heat buildup, and/or having relatively large permanent magnets therein, and having a reliable interconnection between the actuating means and the fin.

SUMMARY OF THE INVENTION

Accordingly, an object of the invention is to provide a fin assembly having relatively large permanent magnets which are not limited in size to the confines of the vehicle hull and which reduce the current required for generation of high turning force applications to the fin.

Another object of the invention is to reduce heat buildup in the stator, such that to the extent such is required, high currents will not precipitate thermal problems in the vehicle.

A still further object of the invention is to provide an interconnection between the fin and fin-turning motive means which is reliable and not subject to stripping of splines, threads, or the like.

With the above and other objects in view, as will hereinafter appear, a feature of the present invention is the provision of a fin assembly for a vehicle, the fin assembly being adapted to effect guidance of the vehicle through a fluid medium. The assembly includes an electromagnet means fixed in a portion of the vehicle, and a rigid shaft fixed to a hull portion of the vehicle and extending outwardly from the hull portion and in alignment with the electromagnet means. A fin is rotatably mounted on the shaft, the fin comprising at least in part a permanent magnet. Switch means are provided in the vehicle for effecting in a first portion of the electromagnet means an attractive force between the electromagnet means and the permanent magnet, and in a second portion of the electromagnet means a repelling force between the electromagnet means and the permanent magnet. The attractive and repelling forces cause the fin to rotate on the shaft in a selected direction such that the fin is acted upon by the fluid medium to effect the guidance of the vehicle.

The above and other features of the invention, including various novel details of construction and combinations of parts, will now be more particularly described with reference to the accompanying drawings and pointed out in the claims. It will be understood that the particular assemblies embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
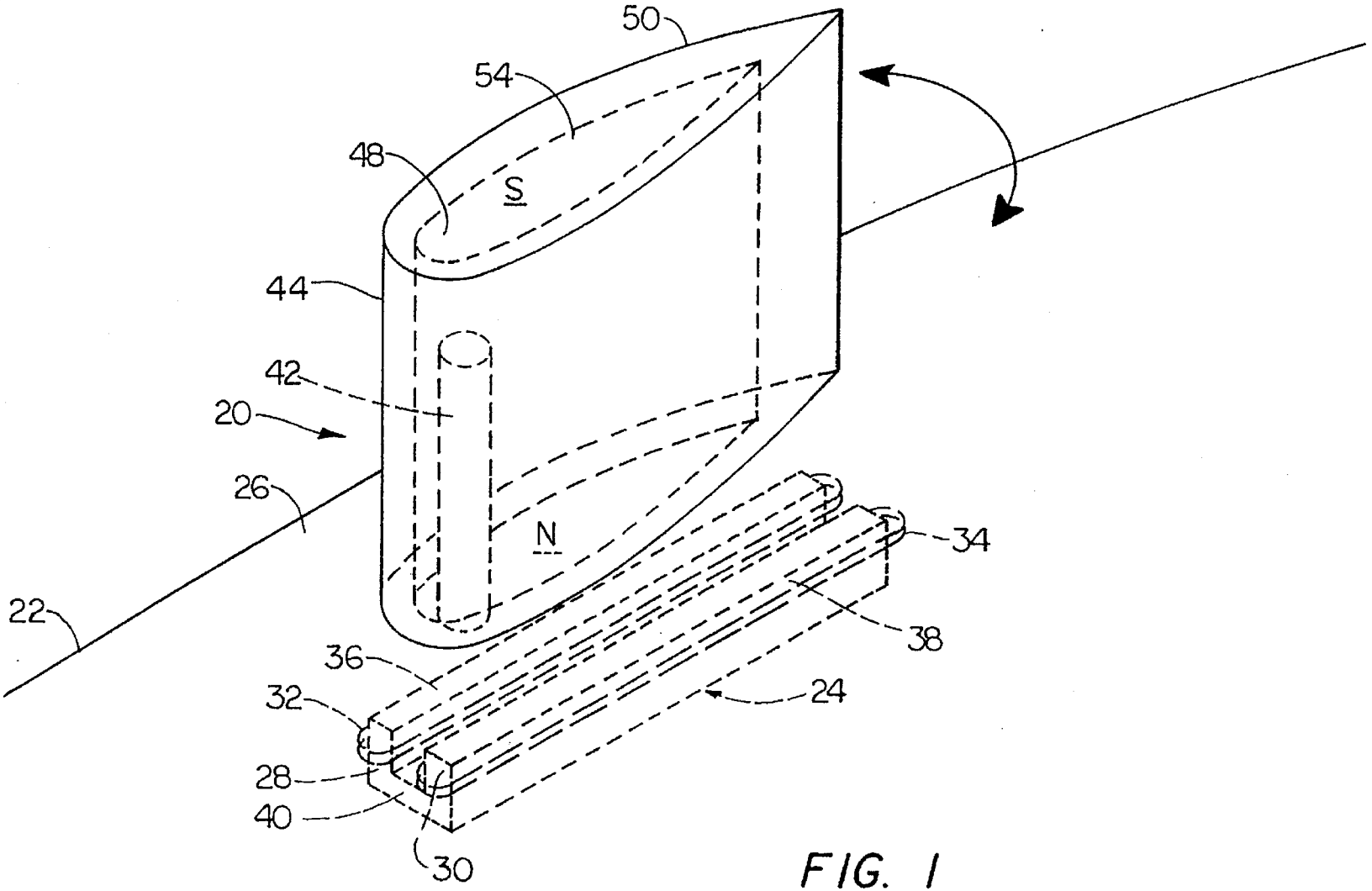
FIG. 1 is a perspective view of one form of fin assembly illustrative of an embodiment of the invention.

Referring to FIG. 1, it will be seen that an illustrative fin assembly 20 for a vehicle 22 includes an electromagnet means 24 which may be disposed within and adjacent to an inside surface of a hull portion 26 of vehicle 22.

Figure 3:
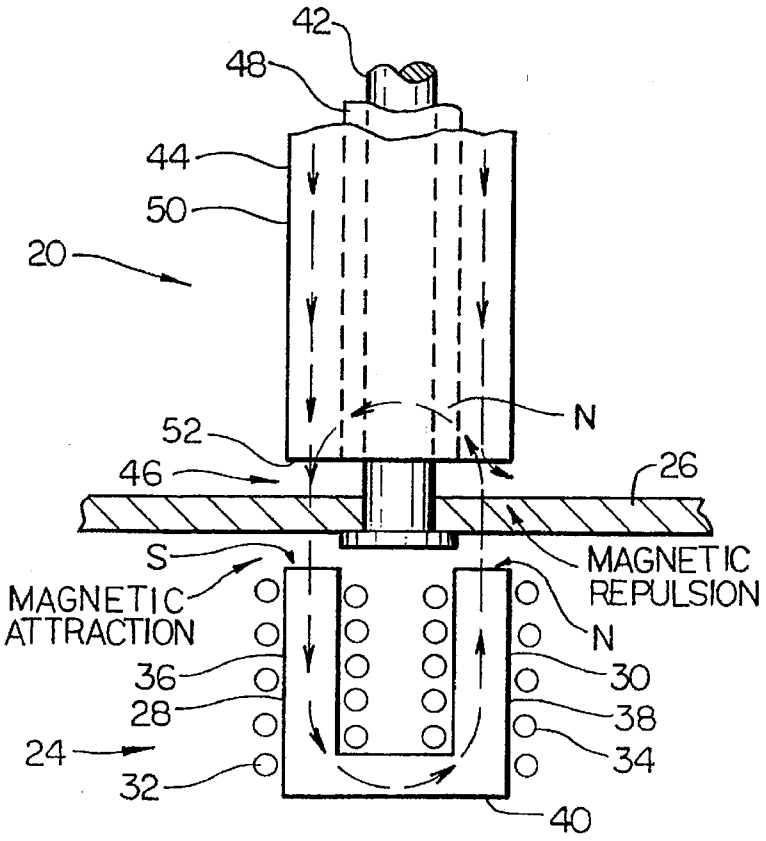
FIGS. 2 and 3 are diagrammatic views of the assembly shown in FIG. 1.
Figure 2:
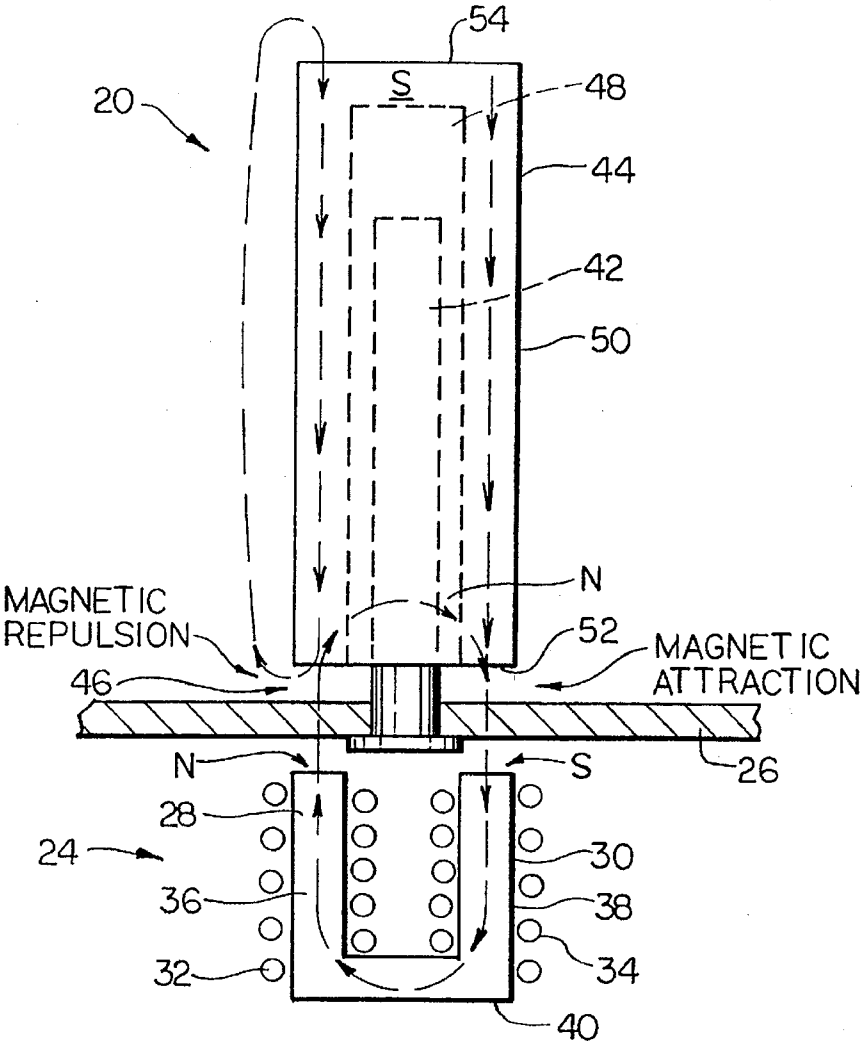

As shown in FIGS. 1–3, electromagnet means 24 can comprise first and second electromagnets 28, 30, having windings 32, 34, respectively, thereon. First and second electromagnets 28, 30 can, in turn, comprise first and second lags 36, 38 of a U-shaped member 40.

A rigid shaft 42 is fixed to hull portion 26 and extends outwardly therefrom. The shaft 42 is aligned with electromagnet means 24, which is proximate shaft 42. A fin 44 is rotatably mounted on shaft 42 and is spaced from hull portion 26, to define a gap 46 (FIG. 2) between hull portions 26 and fin 44. The fin 44 is at least in part a permanent magnet 48. As shown in FIG. 1, fin 44 can comprise a housing 50 having therein permanent magnet 48. Alternatively, the entire fin 44 can constitute permanent magnet 48. Permanent magnet 48 is provided with a permanent north pole N at an inboard end 52 thereof and with a permanent south pole S at an outboard end 54 thereof.

Figure 4:
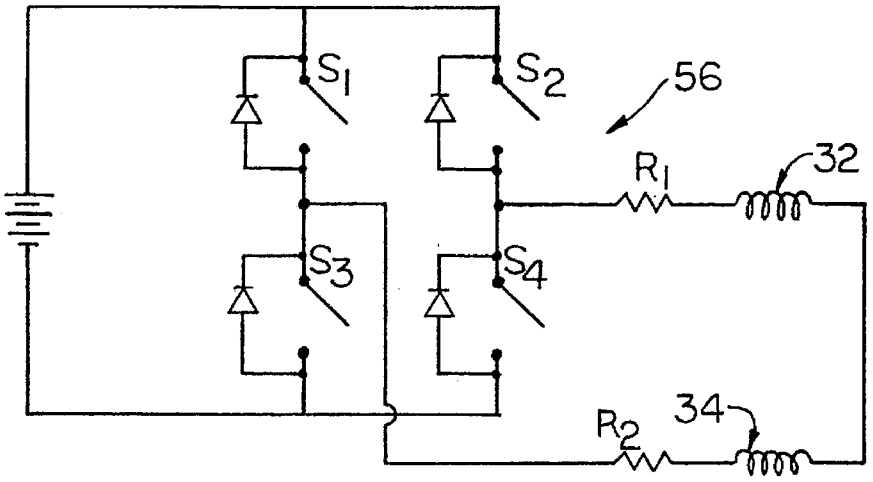
FIG. 4 is a schematic representation of a switch assembly for controlling the fin assembly of FIGS. 1–3.

The windings 32, 34 are activated by a half-bridge switch assembly 56 (FIG. 4) having therein switches $S_1$, $S_2$, $S_3$ and $S_4$. In operation, closing switches $S_2$ and $S_3$, with switches $S_1$ and $S_4$ open, activates windings 32 to create a north magnetic pole N at the free end of first leg 36 and a south magnetic pole S at the free end of second leg 38. Inasmuch as inboard end 52 of fin permanent magnet 48 remains always a north pole, there is repulsion established between permanent magnet 48 and first electromagnet 28 (FIG. 2), and attractions between permanent magnet 48 and second electromagnet 30. The combination of magnetic attractions on one side of fin 44 and magnetic repulsion on the other side of fin 44 causes the fin to rotate on shaft 42.

Similarly, closing switches $S_1$ and $S_4$ with switches $S_2$ and $S_3$ open, activates windings 34 to create a north magnetic pole N at the free end of second leg 38 and a south magnetic pole S at the free end of first leg 36. Repulsion occurs between permanent magnet 48 and second electromagnet 30 (FIG. 3) and attraction occurs between permanent magnet 48 and first electromagnet 28.

Inasmuch as the fin 44 is rotatably mounted on fixed shaft 42 near the forward edge of the fin, and inasmuch as at least a larger portion of permanent magnet 48 is disposed aft of shaft 42 and proximate electromagnet means 24, the magnetic forces cause a pivoting movement of the fin on the shaft. The aforementioned gap 46 between hull portion 26 and fin inboard end 52 accommodates flow of fluid, such as water, along hull portion 26 adjacent electromagnet means 24, effecting cooling of the windings 32, 34 and obviating the need for an internal cooling system, while permitting use of high currents, if necessary. Because the permanent magnet 48 is outside the confines of the vehicle hull, the size of the permanent magnet is not limited by vehicle interior space considerations. Inasmuch as fin 44 pivots freely on shaft 42, there are no splines or threads therebetween susceptible to stripping.

Figure 6:
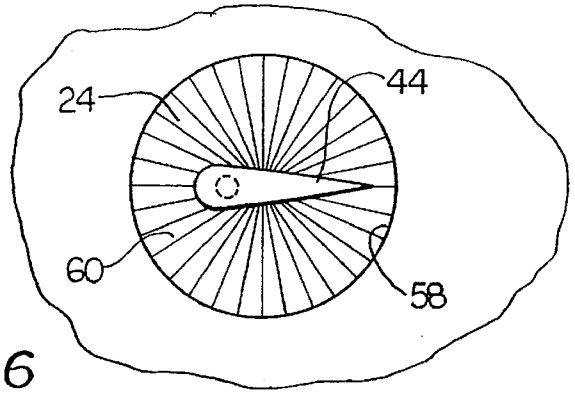
FIG. 6 is a top plan view of the assembly of FIG. 5.
Figure 5:
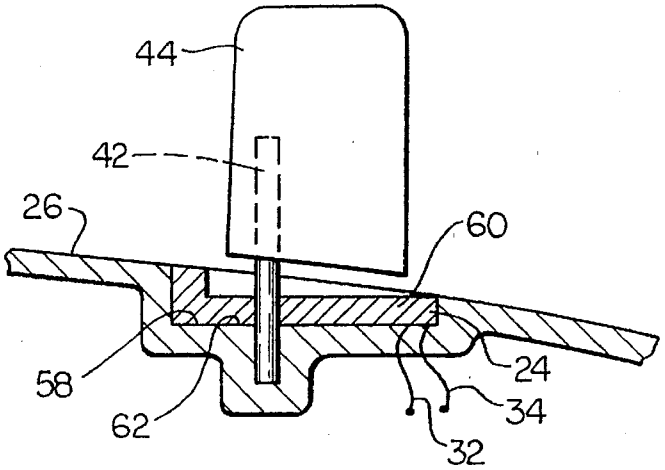
FIG. 5 is a partly elevational and partly sectional view of an alternative embodiment of fin assembly.

In an alternative embodiment shown in FIGS. 5 and 6, hull portion 26 is provided with a recess 58 and electromagnet means 24 comprises a circular stator 60 disposed in recess 58. Shaft 42 is anchored in a bottom 62 of recess 58 and extends through stator 60 and outwardly. As in the previous embodiment, shaft 42 receives fin 44 thereon in rotatable fashion. Activation of stator 60 causes rotation of fin 44 which is itself a permanent magnet, or which includes a permanent magnet. Fin 44 is spaced from stator 60 to permit the flow of cooling fluid therebetween.

Figure 8:
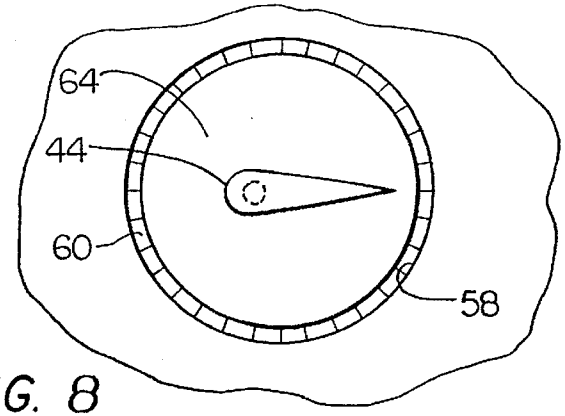
FIG. 8 is a top plan view of the assembly of FIG. 7.
Figure 7:
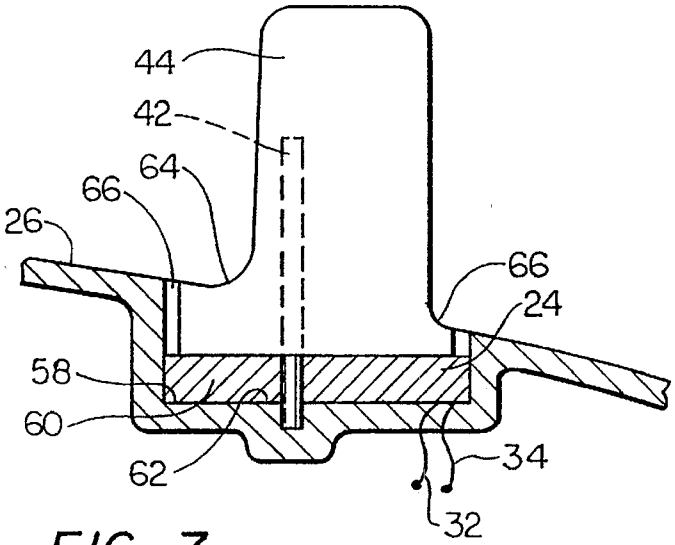
FIG. 7 is similar to FIG. 5, but is illustrative of another alternative embodiment of fin assembly.

In FIGS. 7 and 8, there is illustrated another alternative embodiment in which fin 44 is provided with a circular base portion 64 disposed in recess 58 adjacent stator 60. The base portion 64 provides additional torque and increased magnetic volume. Preferably, the diameter of fin base portion 64 is less than the diameter of recess 58 to define an annular groove 66 for receiving the fluid medium through which vehicle 22 moves, to effect cooling of stator 60.

Figure 10:
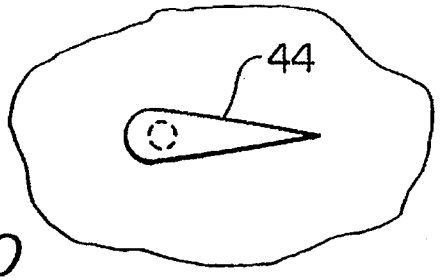
FIG. 10 is a top plan view of FIG. 9.
Figure 9:
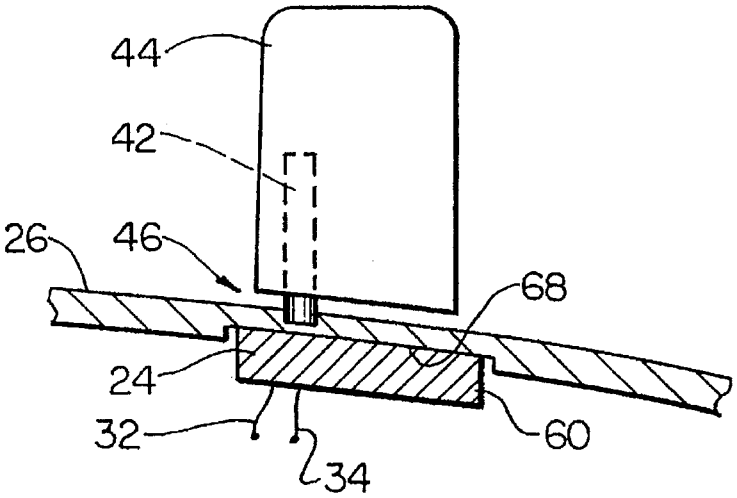
FIG. 9 is similar to FIG. 7, but is illustrative of still another alternative embodiment of fin assembly.

In FIG. 10, there is shown a further alternative embodiment, similar to that shown in FIG. 1, but in which the electromagnet means 24 is a circular stator 60 disposed in an internal recess 68 of the hull portion 26. Again, the gap 46 is provided for flow of fluid to cool stator 60.

It is to be understood that the present invention is by no means limited to the particular constructions herein disclosed and/or shown in the drawings, but also comprises any modifications or equivalents within the scope of the claims.

What is claimed is:

1. A fin assembly for a vehicle, said fin assembly being adapted to effect guidance of the vehicle through a fluid medium, said fin assembly comprising:

an electromagnet means fixed in a portion of the vehicle;

a rigid shaft fixed to a hull portion of the vehicle and extending outwardly from said hull portion and in alignment with said electromagnet means;

a fin rotatably mounted on said shaft, said fin comprising at least in part a permanent magnet; and switch means in the vehicle for effecting in a first portion of said electromagnet means an attractive force between said electromagnet means and said permanent magnet and in a second portion of said electromagnet means a repelling force between said electromagnet means and said permanent magnet;

whereby to cause said fin to rotate on said shaft in a selected direction such that the fin is acted upon by the fluid medium to effect the guidance of the vehicle.

2. The fin assembly in accordance with claim 1 wherein said fin is spaced from an outside surface of said hull portion and said electromagnet means is adjacent an inside surface of said hull portion and proximate said fin.

3. The fin assembly in accordance with claim 1 wherein said electromagnet means comprises first and second electromagnets disposed within said hull portion.

4. The fin assembly in accordance with claim 3 wherein said first and second electromagnets comprise first and second portions of a unitary member.

5. The fin assembly in accordance with claim 1 wherein said fin is mounted on said shaft near a forward edge of said fin, at least a larger portion of said permanent magnet being disposed aft of said shaft and proximate said electromagnet.

6. The fin assembly in accordance with claim 1 wherein said electromagnet means comprises a stator disposed within and adjacent to said hull portion and proximate said fin.

7. The fin assembly in accordance with claim 6 wherein said fin is spaced from said hull portion.

8. The fin assembly in accordance with claim 1 wherein said hull portion is provided with a recess in an outside surface thereof, said electromagnet means comprises a stator disposed in said recess, and said rigid shaft is fixed in a bottom of said recess and extends through said stator and outwardly therefrom.

9. The fin assembly in accordance with claim 6 wherein said fin is provided with a circular base portion disposed in said recess and adjacent said stator.

* * * * *